US007733743B2

(12) United States Patent
Choi et al.

(10) Patent No.: US 7,733,743 B2
(45) Date of Patent: Jun. 8, 2010

(54) COMPREHENSIVE TIME DETERMINING SYSTEM

(76) Inventors: Boaz Baeksung Choi, 24170 Avenida Rancheros, Unit D, Diamond Bar, CA (US) 91765; Eunice Chulsook Choi, 24170 Avenida Rancheros, Unit D, Diamond Bar, CA (US) 91765

( * ) Notice: Subject to any disclaimer, the term of this patent is extended or adjusted under 35 U.S.C. 154(b) by 205 days.

(21) Appl. No.: 11/876,937

(22) Filed: Oct. 23, 2007

(65) Prior Publication Data

US 2009/0103397 A1 Apr. 23, 2009

(51) Int. Cl.
*G04B 19/22* (2006.01)

(52) U.S. Cl. ..... 368/21

(58) Field of Classification Search ..... 368/21–23, 368/27; 235/78 R, 88 R
See application file for complete search history.

(56) References Cited

U.S. PATENT DOCUMENTS

| | | | |
|---|---|---|---|
| 445,392 | A | 1/1891 | Cowell |
| 557,173 | A | 3/1896 | Thompson |
| 1,344,913 | A | 6/1920 | Long |
| 1,607,560 | A | 11/1926 | Pennino |
| 1,975,100 | A | 10/1934 | Grant |
| 2,128,970 | A | 9/1938 | Smyser |
| D141,710 | S | 6/1945 | Guttman |
| 2,463,758 | A | 3/1949 | Freel |
| 2,615,298 | A | 10/1952 | Ferrari |
| D181,407 | S | 11/1957 | Chamberlin |

OTHER PUBLICATIONS

International Search Report and Written Opinion of the International Searching Authority for PCT/US2008/075652 dated Mar. 10, 2009, 8 pages total.

*Primary Examiner*—Edwin A. Leon
(74) *Attorney, Agent, or Firm*—Lawrence N. Ginsberg

(57) ABSTRACT

A comprehensive time determining system includes a list of geographical locations located on a periphery thereof. The base section further includes a plurality of time zones associated with the geographical locations. The time zones are presented on a time strip on the base section. The list of geographical locations on the base section includes locations using standard time only. A first movable section includes a northern hemisphere portion and a southern hemisphere portion. The northern hemisphere portion and the southern hemisphere portion are each independently movable relative to the base section. The northern hemisphere portion includes a list of northern hemisphere geographical locations. The southern hemisphere portion includes a list of southern hemisphere geographical locations. The lists on the first movable sections contains locations using dual time, the northern hemisphere portion and the southern hemisphere portion being movable to select a desired position depending on the season. The first movable section is so arranged and constructed to allow the user to be able to view the time strip located on the base section. A second movable section includes a rotatable dial, the dial being rotatable relative to the base section and to the first movable section. The dial includes evenly spaced markers positioned about a periphery thereof representing the hours in a day. During use, an operator selects a location on either the base section or the first movable section and adjusts the first movable section depending on the season, and sets the dial so that a reference time on the dial element is set to a reference time on the time strip. The user can then use the evenly spaced markers on the dial to determine time at any selected geographical location on the base section or first movable section.

(Continued)

7 Claims, 14 Drawing Sheets

U.S. PATENT DOCUMENTS

| | | | | |
|---|---|---|---|---|
| 3,025,767 | A | 3/1962 | Reffalo | |
| 3,115,002 | A | 12/1963 | Beresford | |
| 3,190,257 | A | 6/1965 | Blythe | |
| 3,360,196 | A | 12/1967 | Grega | |
| 3,807,629 | A | 4/1974 | Ishii | |
| 3,858,334 | A | 1/1975 | Eisenhauer | |
| 3,936,957 | A | 2/1976 | Nordbye | |
| 3,940,920 | A | 3/1976 | Nakamura | |
| 4,032,754 | A | 6/1977 | Ageton | |
| 4,307,458 | A | 12/1981 | Lin | |
| 4,316,272 | A | 2/1982 | Naito | |
| 4,502,789 | A | 3/1985 | Heath | |
| 4,580,814 | A | 4/1986 | Berler | |
| D289,905 | S | 5/1987 | Goldring | |
| 4,681,460 | A | 7/1987 | Nishimura | |
| 4,847,819 | A | 7/1989 | Hong | |
| 5,007,033 | A | 4/1991 | Kubota | |
| 5,054,008 | A | 10/1991 | Darling | |
| 5,303,956 | A | 4/1994 | Zoland | |
| 6,006,986 | A | 12/1999 | Whalen | |
| 6,330,970 | B1 | 12/2001 | Whalen | |
| 6,788,622 | B1 * | 9/2004 | Garcia | 368/21 |
| 7,050,357 | B1 | 5/2006 | Garcia | |
| 7,236,429 | B2 * | 6/2007 | Yeh | 368/21 |

* cited by examiner

COMPREHENSIVE TIME DETERMINING SYSTEM

BACKGROUND OF THE INVENTION

1. Field of the Invention

The present invention relates generally to portable time conversion devices and more particularly to devices that provide the capability of calculating local time, both standard and adjusted, at various places in the world.

2. Description of the Related Art

Although many time calculating or displaying inventions have been introduced over the years, there are still some problems that need to be solved in order to satisfy the needs of users such as frequent travelers, businessmen, international disaster relief workers, and many others. Various inventions have their own strengths, yet it seems that some important problems have not been satisfactorily dealt with.

The following problems have been considered, as the present invention has been developed.

1. Some inventions do not have much space for a list of geographical locations.

2. There are countries such as the U.S.A. that use adjusted (daylight saving) time during part of a year. Unless this problem is properly dealt with, time calculation between these places and other countries that do not change time would be inaccurate or difficult, if not impossible. Moreover, some states or cities within these countries such as Arizona do not adjust time at all while other states adjust time. This can be confusing or may cause serious problems.

3. For places that are not mentioned or addressed on a time calculating device, one has to rely on other methods. Otherwise, one simply cannot calculate the time.

4. When there is ambiguity, how does a user make decisions? For example, when a location is situated between two different 15 degree longitudes, how does the user know the correct choice? When a big country such as the People's Republic of China stretches East to West covering many "time zones" or multiples of 15 degree longitude, how does the user know which time they use or how many time zones they have in the country? Interestingly, China, as large as the contiguous 48 states of the United States, has only one time, which is centered on the capital city, Beijing.

5. For many people living in a country where they have only one time zone or use only one time, it is mind boggling that a country has more than one time. Many Asians seem to be puzzled when they hear that the U.S. has multiple time zones, while many Americans seem to be surprised when they hear that China, a big country as large as the U.S. is using only one time and that they do not have daylight saving time, that is, they use only one time throughout a year.

6. Use of a one half (½) hour time zone also can cause confusion. Not many people living outside of India may know that this country with more than one billion population is five and half (5½) hours ahead of the Greenwich Mean Time (GMT). This one half (½) hour time may limit the use of many time calculating devices. It is noted that Greenwich Mean Time (GMT) is the same as UTC (Coordinated Universal Time) or UT (Universal Time).

7. What about a general question such as "What time is it now in Australia?" Not many people in Asia or the U.S. may know that Australia has three time zones, not to mention that one of these three time zones uses one half hour time. Interestingly, they have three time zones, GMT+8, +9.5, and +10.

8. The use of 15 degree longitude for one hour time zone does not necessarily match with each time zone. For example, in South America, some parts of western Brazil are further East than most of Argentina but Argentina time is one hour ahead of these parts in Brazil.

9. It is necessary to show the bird's eye view of time zones of the world. For example, if one wants to see how many time zones are in the U.S., Australia, India, or China, it is not easy to learn quickly from an ordinary dial type or other slide rule type world time calculators. Also, determining time difference between a particular location and the Greenwich Mean Time should not be too difficult or cumbersome.

10. In order to deal with detailed information, it is necessary to have sufficient space. However, if it takes too much space, it is not easy to carry this calculator or displayer. One needs a system that can be effective and informative, yet, it has to be small enough to be carried around relatively easily.

11. In order to deal with people living in various countries and cultures, more than one language or script should be considered.

Thus, in order to deal with all the aforementioned issues, it is necessary to show the bird's eye view of the world as well as the detail list of locations using a particular time. Furthermore, for those who are not familiar with world time, it would be good to provide some types of explanation of important concepts or background information (such as the definition and history of daylight saving time). Index of many countries and cities of the world is also needed for quick references.

U.S. Pat. No. 7,050,357, issued to Garcia, entitled "Global Time Indicator" discloses a global time indicating calculator that has a clock member with a rotating dial for calculating global standard time and advanced time in various international time zones. Indicia printed on the face of the dial and corresponding boxes on oppositely opposed faces of the calculator can be easily referenced to determine time of day at selected locations throughout the world. The faces have recesses therein to interchangeably accommodate the clock member whereby the calculator can be modified to calculate the time of day during either standard time or advanced time periods. But it may be difficult for non-Americans who do not know the definition of some concepts and abbreviations used on the device. For example, someone in Asia who is not familiar with American time system may wonder "What are the PT, MT, CT, ET?" or "When do they use the advanced time?" This invention also seems to have problem with space. If a location is not listed on the device, how can a user find the correct time? Since names are not arranged alphabetically and no index seems to be provided, one has to struggle to find the desired location. If one wants to know the time of a country instead of a city, it is not easy unless he or she is quite familiar with world geography.

U.S. Pat. No. 6,330,970, issued to Whalen, entitled, "Global Time Calculator" discloses a global time calculator that includes an insert and a sleeve. The insert is marked on both its sides (or on a single page slide insert on one side) with vertical columns of incremental time designations, and may or may not contain a stop mechanism. The insert is slidable and connected with the sleeve so as to be shiftable in a vertical direction. Both sides of the sleeve (or in some embodiments a single side of the sleeve) have areas for obscuring vertically aligned time designations that are in excess of unobscured time designations. But this device does not handle daylight saving time and time zones that use one half hour time.

U.S. Pat. No. 5,303,956, issued to Zoland, entitled, "Time Zone Conversion Chart for Card, Luggage Tag or Key Chain" discloses a travel document folder, card case or luggage tag that features a time zone conversion chart. But this device does not provide many locations due to limited space and size of the dial.

U.S. Pat. No. 5,007,033, issued to Kubota et al., entitled, "World Timepiece" discloses a world timepiece for normally displaying the time of a home city and for selectively displaying the time of another city situated in another time zone. The world timepiece includes a plurality of selector switches corresponding to main cities located in different time-lag zones into which the world is divided. A display unit normally displays the time of the user's home city and, upon actuation of one of the selector switches, the display unit displays the time of the selected city designated by the actuated selector switch. A city of an arbitrary time-lag zone can be stored in an assigned city storage circuit, and the time of the assigned city can be displayed by the display unit by actuating an optional switch. This invention does not list many cities that belong to the same time zone. A foreigner who does not have extensive knowledge of the regional geography such as various time zones of the U.S. may have difficulty using it. Another problem is that use of daylight saving time is not clearly addressed. For example, most of the U.S. uses daylight saving time part of a year, but there are exceptions for some areas and cities.

U.S. Pat. No. 4,681,460, issued to Nishimura, entitled, "World Time Watch" discloses a world time watch that has a liquid crystal display device including a time zone display and a time display. The time zone display is provided to display the time difference between a selected place and the Greenwich Mean Time, and the time display is provided to display the time of the place corresponding to the time difference displayed in the time zone display. A printed place name list is provided around the liquid crystal display device. The place name list includes a plurality of numbers each of which represents the corresponding time difference of a particular place. The Nishimura device does not deal with half hour time zone and adjusted time (daylight saving time). Also, space allocated for each time zone is not enough.

U.S. Pat. No. 4,032,754, issued to Ageton, entitled, "Global Time System" discloses a global time system having a first disc divided into twenty-four equal sections, each section being formed by lines extending radially from the center of the first disc. Each line forming the sections represents a line of longitude. Circles are concentrically disposed about the center of the disc and extend outward to the edge of the disc. The circles, representing lines of latitude, cross over each of the twenty-four lines of longitude to form geographic spaces between the lines of longitude and latitude. A time disc is rotatably mounted to the center of the first disc and has twenty-four lines equally spaced from each other on the outside edge. Reference symbols are positioned on the first disc and adjacent to the outside edge of the time disc, with the reference symbol in each of the twenty-four sections. Identification symbols representing a specific geographic location are disposed within the respective geographic space having the proper longitude and latitude of the location. However, just knowing reference point, longitude and latitude, cannot provide local time accurately. For example, China stretches out multiple time zones but it uses only one time.

SUMMARY OF THE INVENTION

In a broad aspect, the present invention is a comprehensive time determining system capable of calculating local time, both standard and adjusted, at various places in the world, including places where half hour time zone is used. The system also provides graphic presentation of local time in reference to the Greenwich Mean Time.

The system includes: a) a dial section including a base subsection and a circular dial element rotatably mounted on the base subsection, the dial element including evenly spaced markers positioned about a periphery thereof representing the hours in a day, the base subsection including multiple connecting elements representing corresponding time zones, each originating at respective spaced locations about the periphery of the dial element; b) a list section, located adjacent to the dial section, including at least one list of geographical locations and their associated time zones presented on a time strip that is associated with the connecting elements; and, c) a map section, located adjacent to the dial section, including a regional map subsection adjacent to a world map subsection that are both illustrated with time zones thereon, the world map subsection also including a time strip on an edge thereof, the time strip including numbers denoting the time difference between a time zone and the Greenwich Mean Time.

During use, an operator first sets the dial element so that a reference time on the dial element is set to a reference time zone on the base subsection, and can then use the connecting elements to determine time at any selected geographical location on the list section.

In another broad aspect, a comprehensive time determining system is embodied as a base section that includes a list of geographical locations located on a periphery thereof. The base section further includes a plurality of time zones associated with the geographical locations. The time zones are presented on a time strip on the base section. The list of geographical locations on the base section includes locations using standard time only. A first movable section includes a northern hemisphere portion and a southern hemisphere portion. The northern hemisphere portion and the southern hemisphere portion are each independently movable relative to the base section. The northern hemisphere portion includes a list of northern hemisphere geographical locations. The southern hemisphere portion includes a list of southern hemisphere geographical locations. The lists on the first movable sections contains locations using dual time, the northern hemisphere portion and the southern hemisphere portion being movable to select a desired position depending on the season. The first movable section is so arranged and constructed to allow the user to be able to view the time strip located on the base section. A second movable section includes a rotatable dial, the dial being rotatable relative to the base section and to the first movable section. The dial includes evenly spaced markers positioned about a periphery thereof representing the hours in a day.

During use, an operator selects a location on either the base section or the first movable section and adjusts the first movable section depending on the season, and sets the dial so that a reference time on the dial element is set to a reference time on the time strip. The user can then use the evenly spaced markers on the dial to determine time at any selected geographical location on the base section or first movable section.

DETAILED DESCRIPTION OF THE INVENTION

Figure 1:
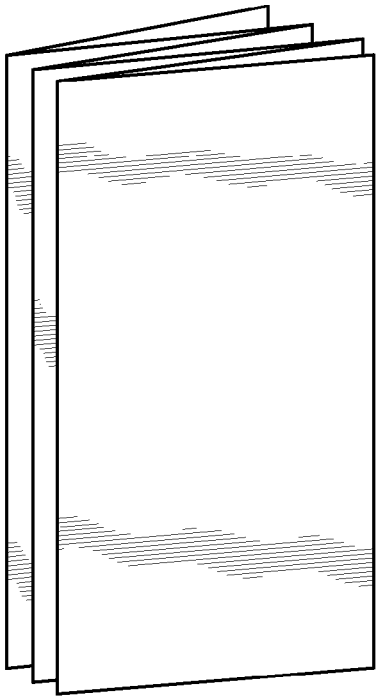
FIG. 1 is a perspective of the first embodiment of the invention, partially unfolded.
Figure 2B:
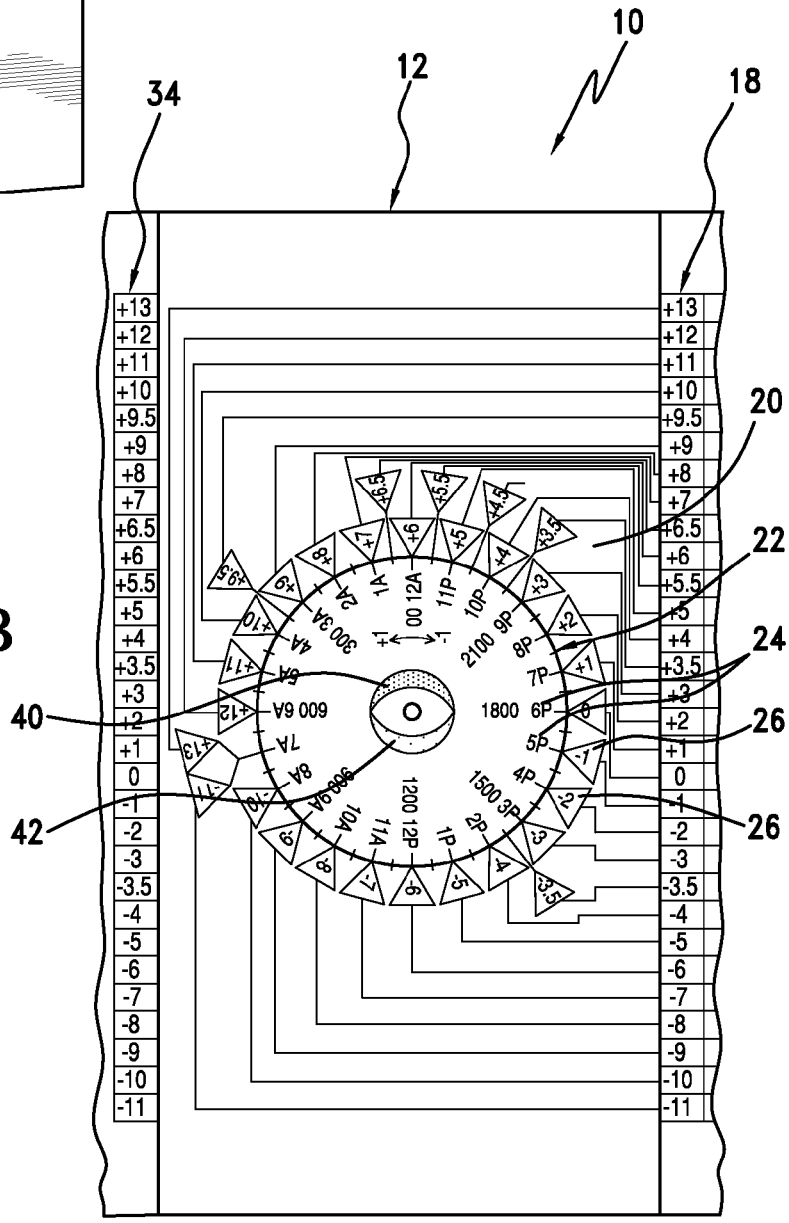
FIG. 2B is an elevational view of a dial section, an adjacent time strip and time zones thereof.
Figure 2A:
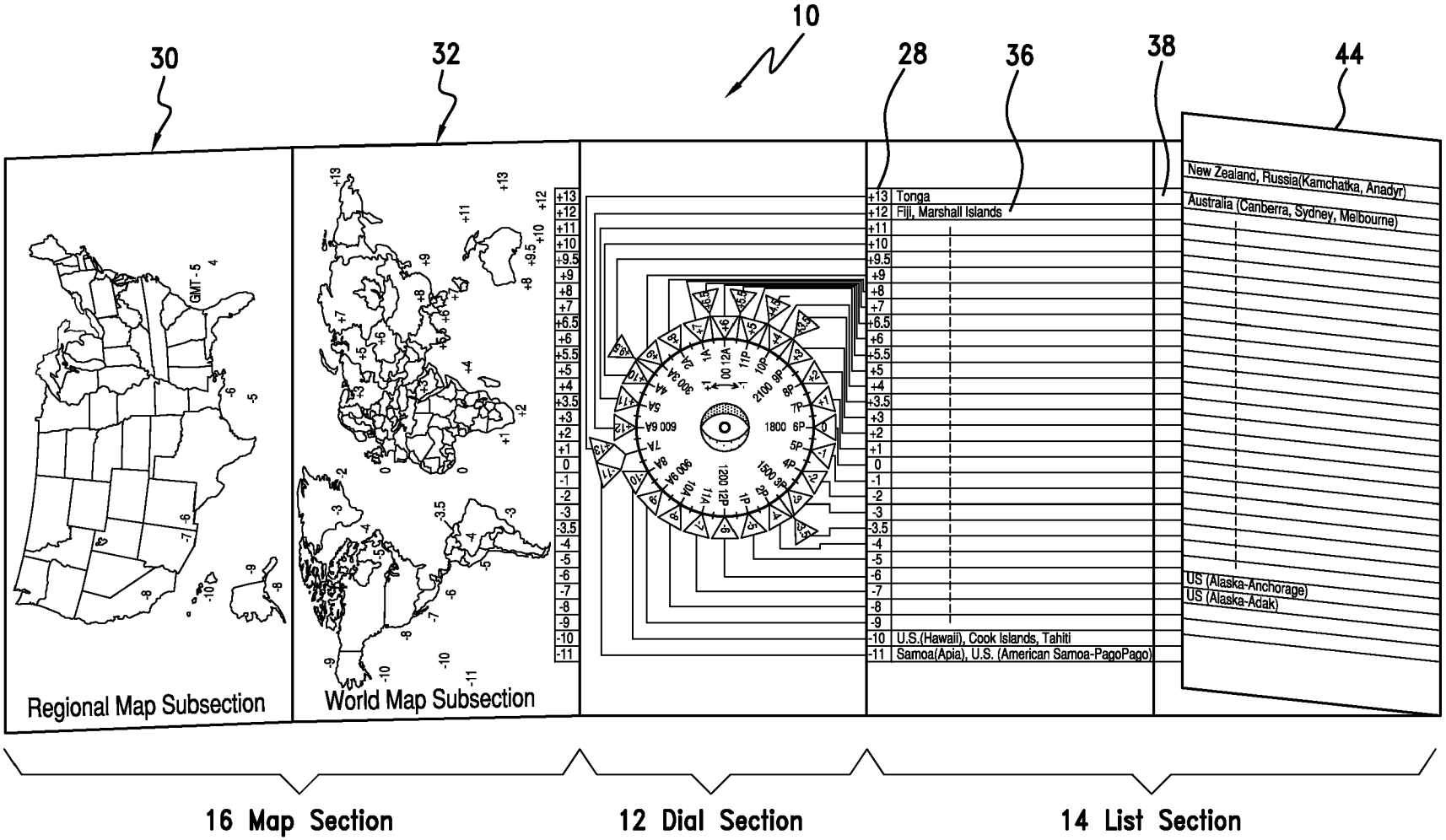
FIG. 2A is a front view thereof.

Referring now to FIGS. 1 and 2A, a first embodiment of the comprehensive time determining system of the present invention, partially unfolded, is illustrated, designated generally as 10. The system 10 includes a dial section 12, a list section 14 and a map section 16. Referring to FIG. 2B, an elevated view of the dial section 12, an adjacent time strip 18 and time zones are illustrated. The dial section 12 includes a base subsection 20 and a circular dial element 22 rotatably mounted on the base subsection 20. The circular dial element 22 includes evenly spaced markers 24 positioned about a periphery thereof representing the hours in a day. The base subsection 20 includes a plurality of connecting elements 26, each originating at respective spaced locations about the periphery of the circular dial element 22, each connecting element 26 representing a corresponding time zone. The list section 14, located adjacent to the dial section 12, comprises at least one list of geographical locations 28 and their associated time zones. The time zones are presented on the time strip 18, the time zones on the time strip 18 being associated with the connecting elements 26. During use, an operator first sets the circular dial element 22 so that a reference time on the dial element 22 is set to a reference time zone on the base subsection 20, and can then use the connecting elements 26 to determine time at any selected geographical location on the list section 14.

The map section 16 of the system 10 is positioned adjacent to the dial section 12. The map section 16 includes a regional map subsection 30 and a world map subsection 32. The regional map subsection 30 is illustrated with time zones presented thereon. The world map subsection 32 also includes time zones presented thereon and a second time strip 34 on an edge thereof. The time strip 34 includes numbers denoting the time difference between a time zone and the Greenwich Mean Time.

The connecting elements 26 are color coded and notated with numbers representing the corresponding time zones. The color of each time zone on a map, time strip and connecting element should be matched for easy recognition.

The list section 14 includes a standard time only subsection 36 listing geographical locations that use only standard time. The geographical locations are listed in the descending order of time difference between the Greenwich Mean Time and the local time of the geographical locations. A first side of the standard time only subsection 36 is adjacent to the dial section 12.

The list section 14 includes a dual time subsection 38 listing geographical locations that use dual time wherein dual time includes standard time and adjusted time. The geographical locations are preferably listed in the descending order of time difference between the Greenwich Mean Time and the local time of the geographical locations. The dual time subsection 38 is positioned adjacent to a second side of the standard time only subsection 36.

The standard time only subsection 36 is foldable relative to the dial section 12 and the dual time subsection 38 is foldable relative to the standard time only subsection 36.

The list section 14 can be alternatively positioned 90 degrees relative to the dial section 12. The time strip on the standard time only subsection 36 can be in ascending order or descending order, depending upon how the list section 14 is positioned.

The connecting elements 26 include lines that connect to the time strip 18. One end of the connecting element 26 of the base subsection 20 of the dial section 12 for the Greenwich Mean Time (GMT) +13 points to −11, +1 being noted near +13 and −1 being noted near −11 to indicate that there is a 24 hour time difference between +13 zone and −11 zone (cf. FIGS. 7A, 7B, 11A, and 11E).

The world map subsection 32 of the system 10 is positioned to the left side of the dial section 12, displaying time difference in reference to the Greenwich Mean Time numerically. The second time strip 34 is marked with increments of hour and half an hour adjacent to one side of the world map subsection 32.

The regional map subsection 30 of the system 10 is positioned to the left side of the world map subsection 32, displaying different time zones using different colors and numbers in reference to the Greenwich Mean Time, both for standard time and adjusted time, when dual time is applicable.

The regional map subsection 30 and the world map subsection 32 of the system 10 are positioned 90 degrees relative to the dial section 12.

A regional map with time zones marked displays the different time zones using different colors and numbers in reference to GMT or printed clocks, both for standard time and adjusted (daylight saving) time, when adjusted time is applicable. Within a country where daylight saving time is used, those exceptional locations such as states and cities which do not use adjusted (daylight saving) times when other locations in the same country use the adjusted (daylight saving) time may be marked with a notation.

The regional map subsection 30 and the world map subsection 32 can be positioned 90 degrees relative to the dial section 12. The second time strip 34 can be positioned to the top or the bottom of the world map section 32 depending on whether the world map subsection 32 is positioned.

The regional map subsection 30 of the system 10 includes multiple regional maps that have substantially similar sizes and are foldable on connecting borders therebetween.

The regional map subsection 30 of the system 10 includes multiple regional maps and a transparency jacket. The regional maps are insertable into the transparency jacket and the transparency jacket is foldable relative to the world map subsection 32. The regional maps may be connected to one another side by side, or above the top or below the bottom of other regional maps and they may be folded on the connecting border of each other.

The circular dial element 22 of the system 10 includes at least 48 equally spaced segments, each of the segments representing an increment of a half hour.

The circular dial element 22 of the system 10 is marked with two colored crescent moon shapes near the center thereof, a first moon shape 40 covering from 6 pm to 6 am having a color denoting night time; and, a second moon shape 42 covering from 6 am to 6 pm having another color denoting day time.

The system 10 further includes an auxiliary subsection 44 listing geographical locations using dual time for an adjusted time period. The auxiliary subsection 44 is adjacent to the dual time subsection 38 and foldable relative to the dual time subsection 38. Alternately, the auxiliary subsection 44 may be split to provide northern hemisphere and southern hemisphere locations. In such an instance, when the northern hemisphere uses advanced time that section can be folded only so that advanced time can be shown. The same is true for the southern hemisphere.

Figure 3:
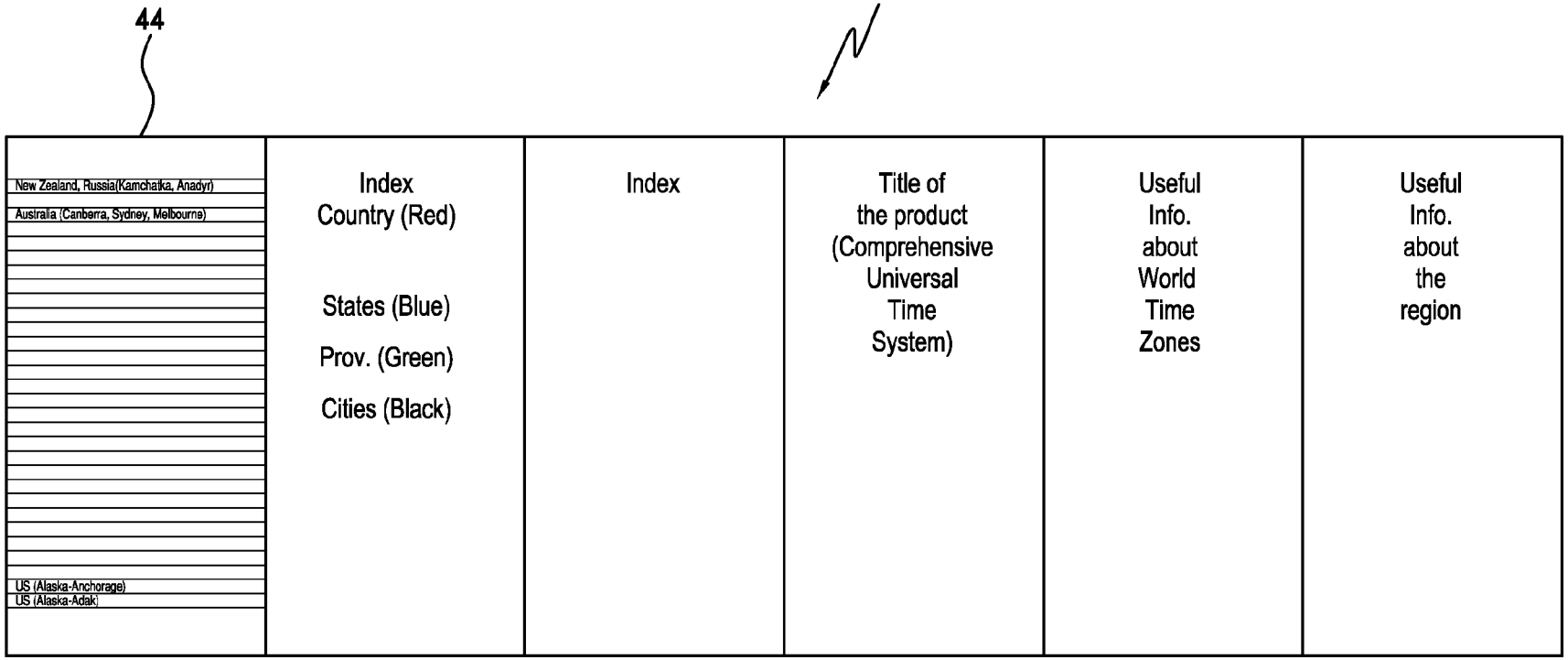
FIG. 3 is a rear view thereof.

Referring now to FIG. 3, a rear view of the system 10 is illustrated. The title of the product "Comprehensive Time Determining System", company information, copyright and patent notice, etc. is printed on the rear side of the dial section 12. Useful information about world time zones and useful information about the region may be printed on the rear side of the world map subsection 32 and the regional map subsection 30, respectively. Index information may be printed on the rear side of the list section 14. The index information includes countries, states/provinces, and cities and can be color coded.

Figure 4:
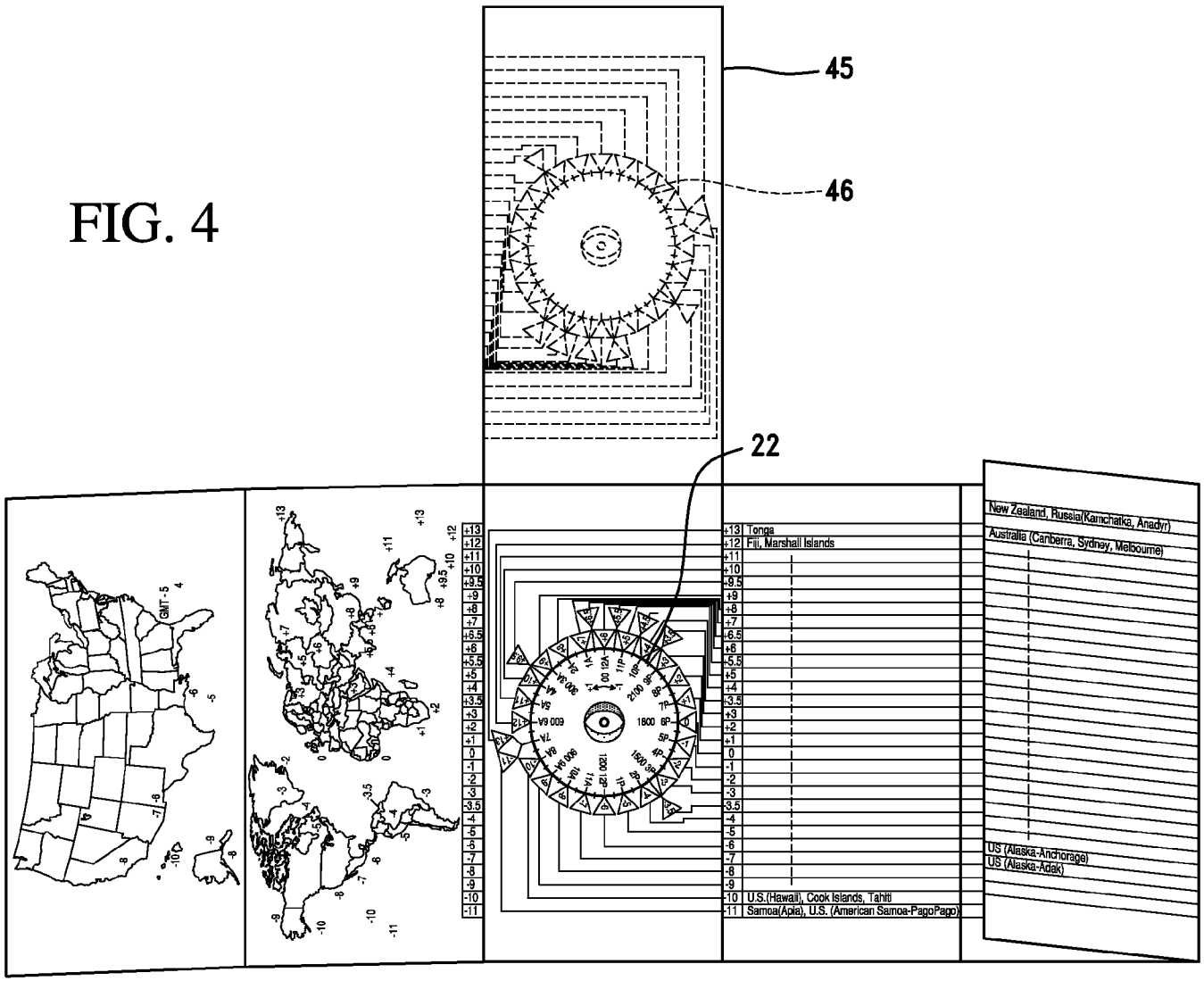
FIG. 4 is a front view thereof with an upper flap that has an added dial section.

The dial section 12 of the system 10 may include multiple dials that are adjacent to one another and foldable relative to one another. Referring to FIG. 4, an embodiment is illustrated, with an upper flap 45 containing a second dial 46 that is foldable relative to the first dial 22.

Figure 5:
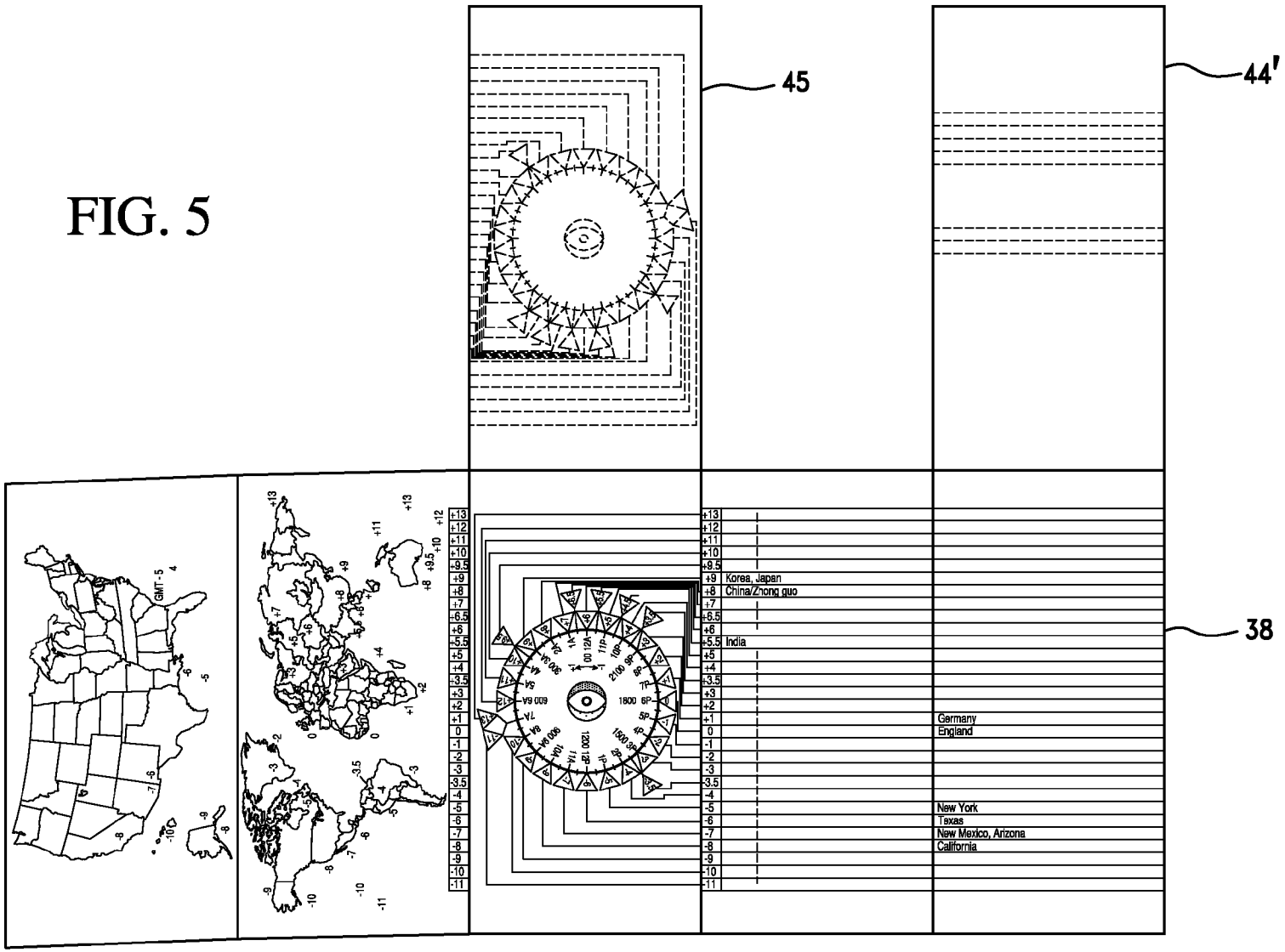
FIG. 5 is a front view thereof with an auxiliary subsection rotated to another location.

The auxiliary subsection 44 (as shown in FIG. 3) can be positioned 90 degrees relative to the list section 14. Referring to FIG. 5, an embodiment where an auxiliary subsection 44' that is positioned on the top of the dual time subsection 38 and foldable relative to the dual time subsection 38 is illustrated. The auxiliary subsection 44' can be split for the northern hemisphere and the southern hemisphere as discussed above. That means one subsection for the northern hemisphere at the bottom and one for the southern hemisphere at the top. If Europe and North America do not adjust time at the same time, one may be added at the side.

Figure 6B:
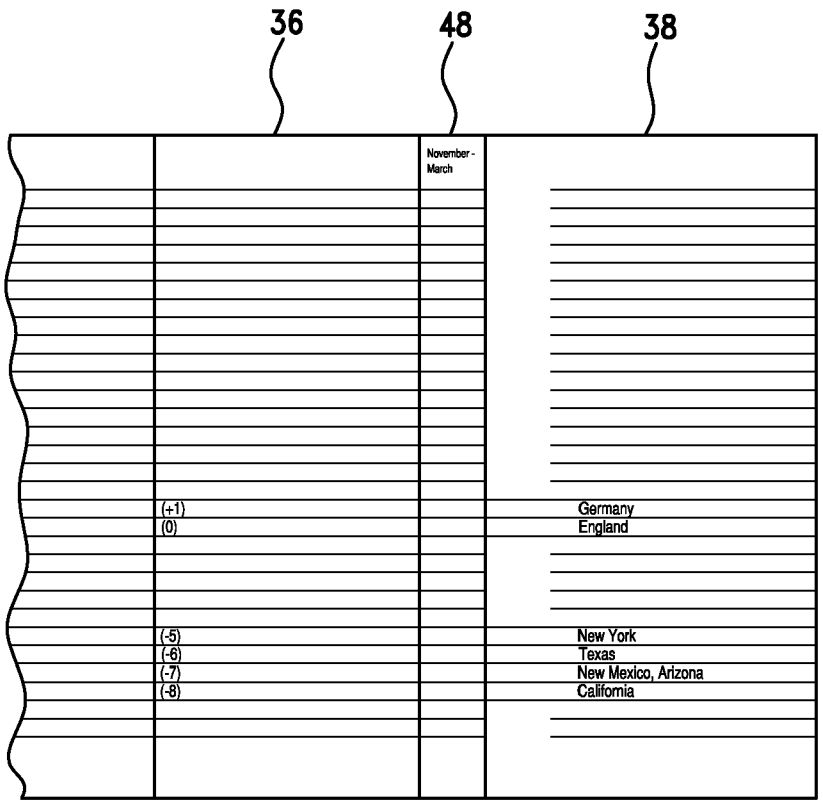
FIG. 6B shows use of the small flap to change for daylight saving time with the flap positioned to Summer in the northern hemisphere.
Figure 6A:
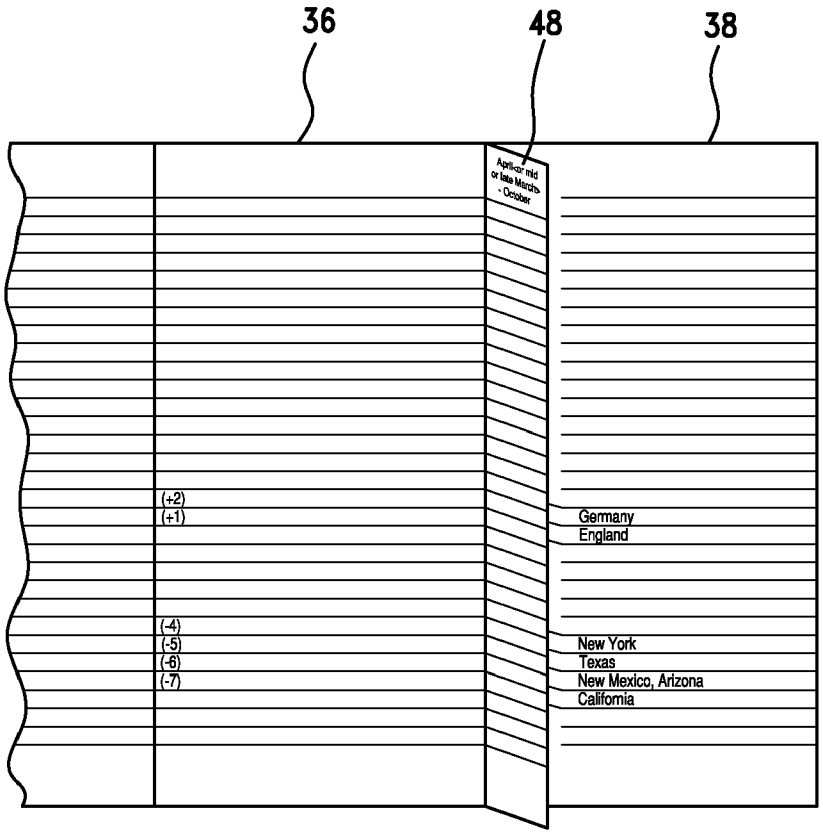
FIG. 6A shows use of a small flap to change for daylight saving time with the flap positioned to Winter in the northern hemisphere.

Referring now to FIG. 6A, the system 10 may include a flap 48 with connecting lines marked on both sides, one side with horizontal lines connecting to the standard time only subsection 36 and the other side with slanted lines connecting to the dual time subsection 38. The flap 48 is generally positioned on a border between the standard time only subsection 36 and the dual time subsection 38; and the flap 48 is foldable relative to both the standard time only subsection 36 and the dual time subsection 38, the slanted lines being used to advance local time of a connected time zone in the dual time subsection during an adjusted time period. Referring to FIG. 6A, the flap 48 being set for adjusted time is illustrated. Referring to FIG. 6B, the flap 48 being set for standard time is illustrated. For example, during winter, in the northern hemisphere, Central Time zone (in the U.S.) is connected to GMT−6 zone but during summer time, it will be connected to GMT−5 zone through a slanted connecting line. Likewise, Eastern time zone (in the U.S.) during winter season will be connected to GMT−5, then during summer, to GMT−4. Thus, the space for dual time zone may be saved, because it does not need space for almost identical content. This method may be good for a smaller version of this present invention. In order to cover both northern and southern hemispheres, the flap may be split: at least one for northern hemisphere and another for southern hemisphere. (If North America and Europe do not change at the same time, the one for northern hemisphere may be separated as well: i.e., one for North America, another for Europe. In this case, there will be three flaps: one for southern hemisphere, another for North America, a third one for Europe.) During winter in the northern hemisphere, the flap for northern hemisphere may show horizontal lines, while the one for the southern hemisphere slanted lines. During summer in the northern hemisphere, the flap for northern hemisphere may show slanted lines, whereas the flap for southern hemisphere may show horizontal lines.

Figure 7A:
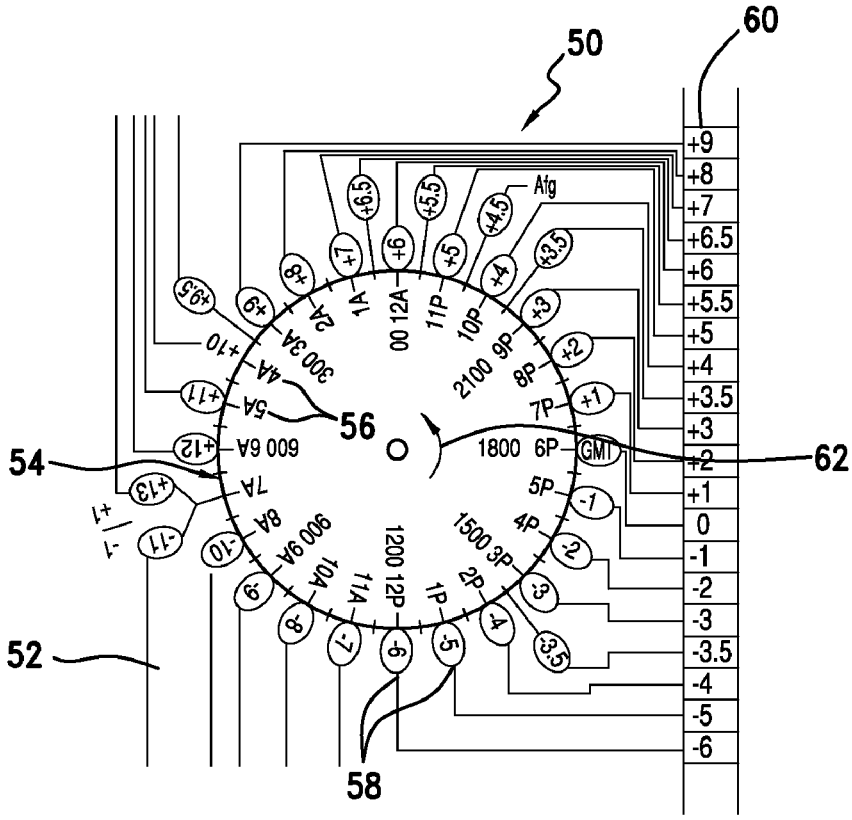
FIG. 7A shows a dial with counter clockwise progress of time.

Referring now to FIG. 7A, a dial 50 with counter clockwise progress of time is illustrated. The dial 50 includes a base section 52 and a circular dial element 54 rotatably mounted on the base subsection 52. The circular dial element 54 includes evenly spaced markers 56 positioned about a periphery thereof representing the hours in a day. The base subsection 52 includes a plurality of connecting elements 58, each originating at respective spaced locations about the periphery of the circular dial element 54, each connecting element 58 representing a corresponding time zone. All time zones are presented on a time strip 60 that is associated with the connecting elements 58. The time strip 60 is positioned to the right side of the dial 50. There is a curved arrow 62 on the circular dial element 54 that points the direction of counter clockwise progress of time.

Figure 7B:
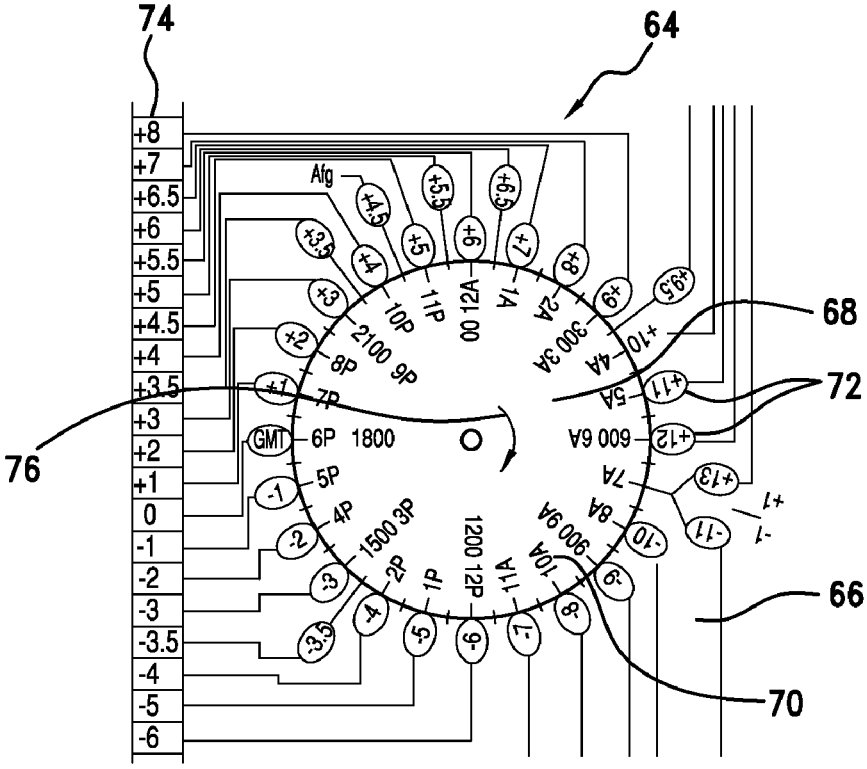
FIG. 7B shows a dial with clockwise progress of time.

Referring now to FIG. 7B, a dial 64 with clockwise progress of time is illustrated. The dial 64 includes a base section 66 and a circular dial element 68 rotatably mounted on the base subsection 66. The circular dial element 68 includes evenly spaced markers 70 positioned about a periphery thereof representing the hours in a day. The base subsection 66 includes a plurality of connecting elements 72, each originating at respective spaced locations about the periphery of the circular dial element 68, each connecting element 72 representing a corresponding time zone. All time zones are presented on a time strip 74 that is associated with the connecting elements 72. The time strip 74 is positioned to the left side of the dial 64. There is a curved arrow 76 on the circular dial element 68 that points the direction of clockwise progress of time.

Figure 8:
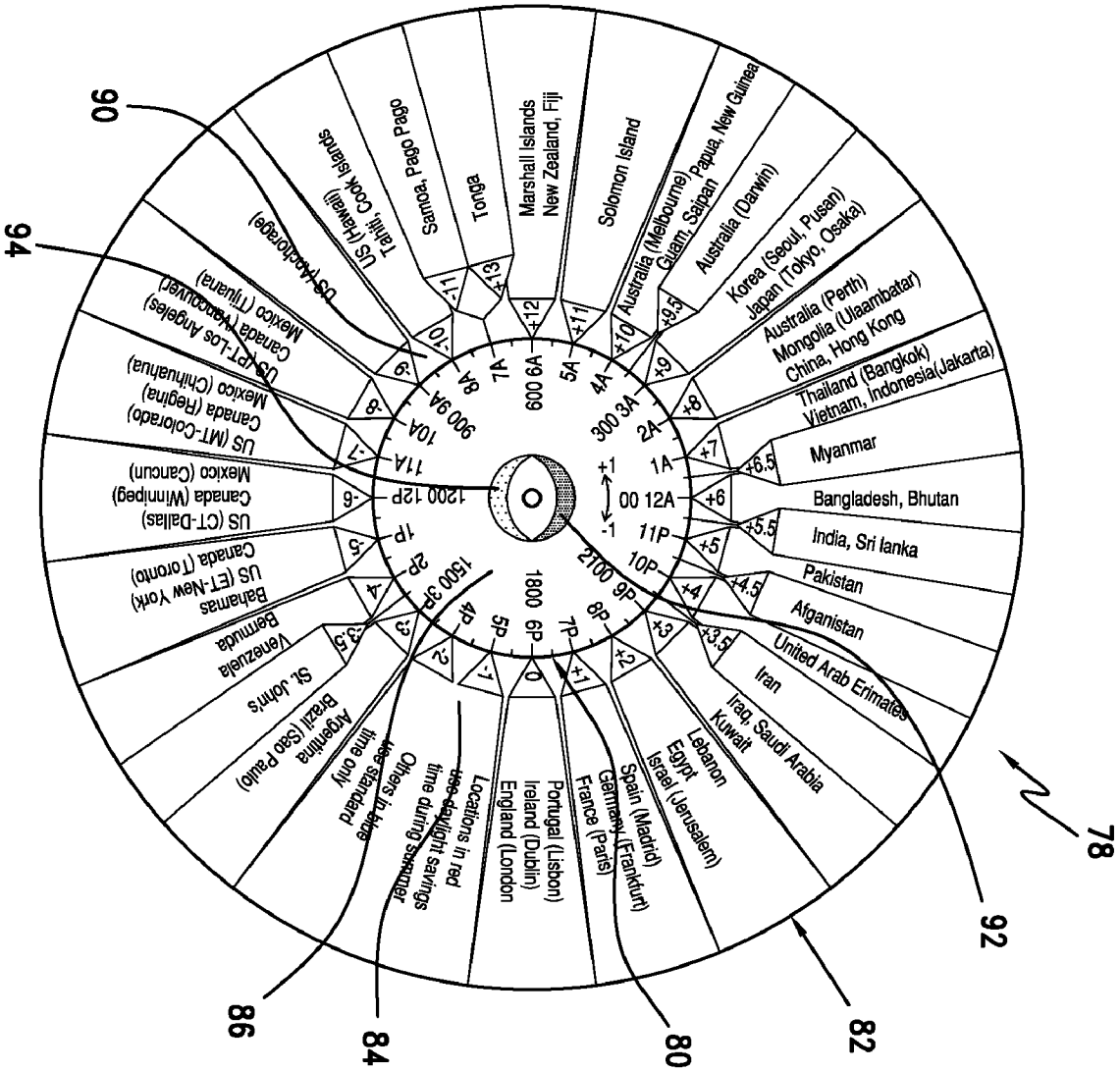
FIG. 8 is a front view of a second embodiment of the invention.

Referring now to FIG. 8, a second embodiment of the comprehensive time determining system is illustrated, designated generally as 78. The system 78 includes a dial section 80 and a list section 82. The dial section 80 includes a base subsection 84 and a circular dial element 86 rotatably mounted on the base subsection 84. The circular dial element 86 of the dial section 80 includes evenly spaced markers 88 (the same as 56 in FIG. 7A) positioned about a periphery thereof representing the hours in a day, the base subsection 84 including multiple connecting elements 90, each originating at respective spaced locations about the periphery of the circular dial element 86, each connecting element 90 representing a corresponding time zone. The list section 82 located adjacent to the dial section 80, the list section 82 including one list of geographical locations and their associated time zones, the geographical locations originating at respective spaced locations about the periphery of the connecting elements 90. During use, an operator first sets the circular dial element 86 so that a reference time on the dial element 86 is set to a reference time zone on the base subsection 84, and can then use the connecting elements 90 to determine time at any selected geographical location on the list section 82.

The connecting elements 90 of the system 78 are preferably color coded and notated with numbers representing the corresponding time zones.

The dial element 86 of the system 78 is marked with two colored crescent moon shapes near the center thereof, a first moon 92 shape covering from 6 pm to 6 am having a color denoting night time; and, a second moon shape 94 covering from 6 am to 6 pm having another color denoting day time. Places that use dual time may be marked with a distinct color or a symbol such as an asterisk (*). Time can be adjusted by appropriate movements forward or backward. Different coloring schemes can be used. For example, places that use dual time in the northern hemisphere may use red color and southern hemisphere green with pertinent information on the periphery (or back) thereon.

Figure 9:
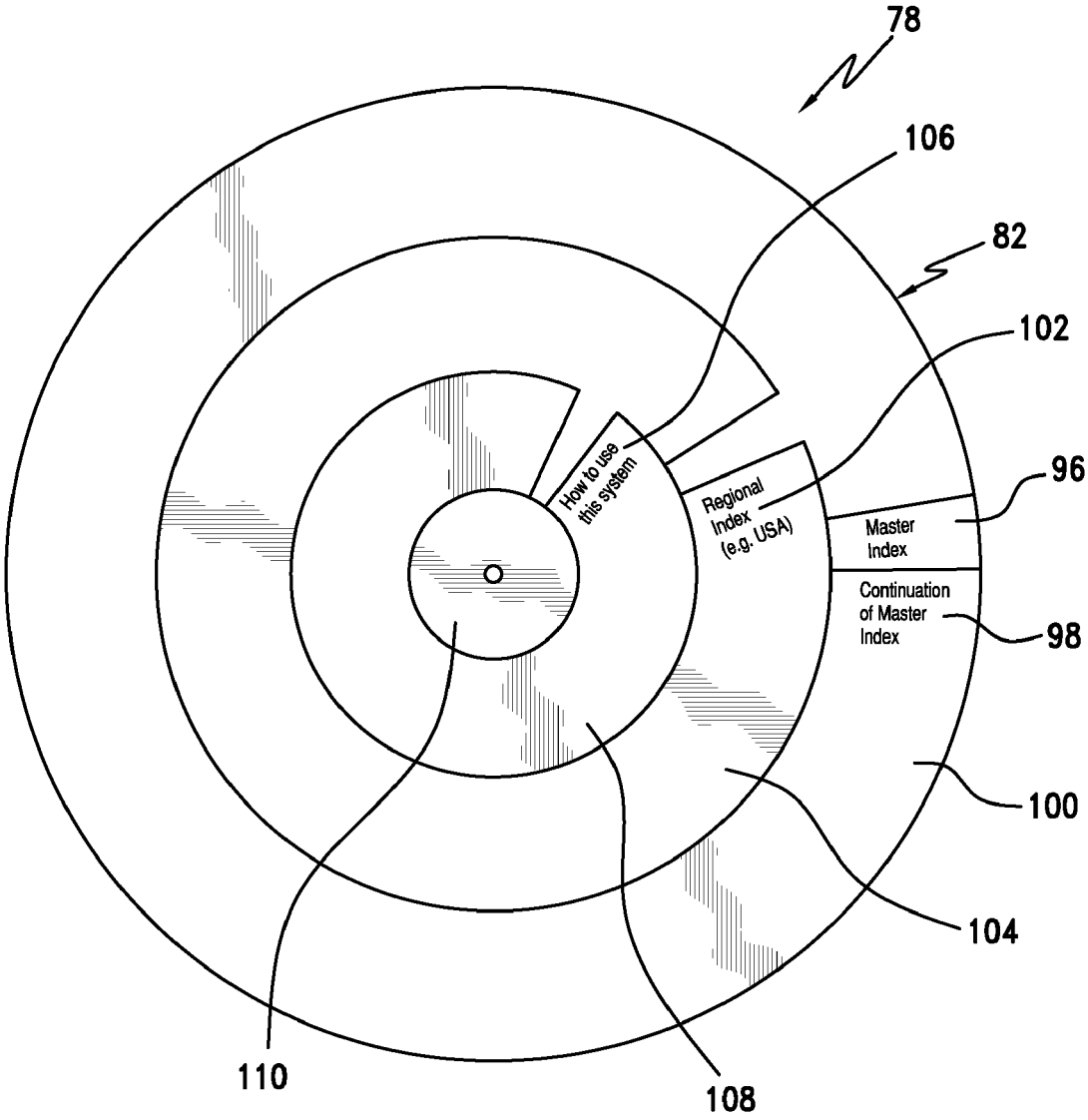
FIG. 9 is a rear view thereof.

Now referring to FIG. 9, a rear view of the system 78 is illustrated. There are four circular elements concentrically and rotatably mounted on the rear side of the base subsection 84 and the list subsection 82. A master index 96 prints on the rear side of the base subsection 84 and the list subsection 82. A continuation of master index 98 prints on a first circular element 100 rotatably mounted on the base subsection 84 that has the same radius as the list subsection 82. A regional index 102, e.g. U.S.A., is printed on a second circular element 104 rotatably mounted on the first circular element. Second circular element 104 has a smaller radius than that of the first circular element 100. A system user guide 106 is printed on a third circular element 108 rotatably mounted on the second circular element 104. Third circular element 108 has a smaller radius than that of the second circular element 104. Product title, company information, copyright and patent notice, etc. may be printed on a fourth circular element 110 that has a smaller radius than that of the third circular element 108.

Figure 10A:
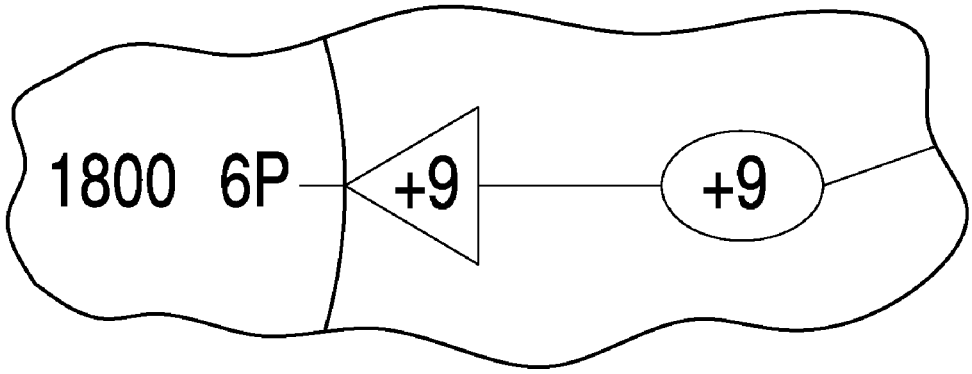
FIG. 10A is a connecting element comprising a connecting line, a pointer and a marker.
Figure 10B:
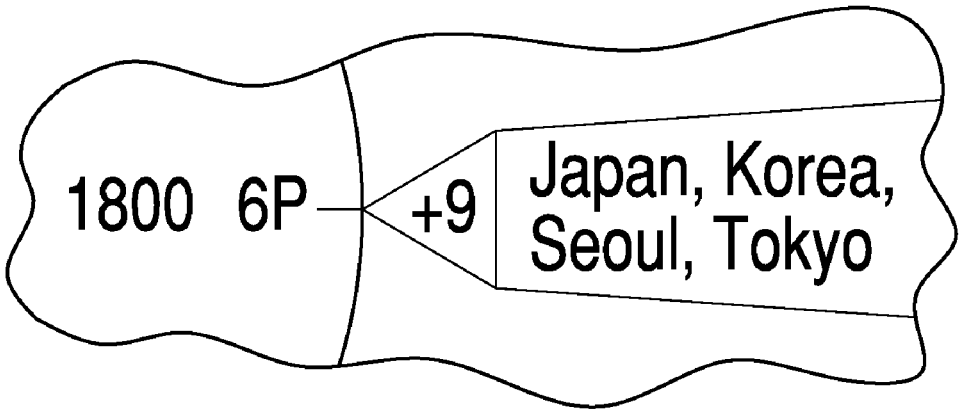
FIG. 10B is a connecting element comprising a pointer associated with a list of geographical locations belonging to a time zone; and, FIG. 10C is a connecting element comprising a modified pointer with an extended line.
Figure 10C:
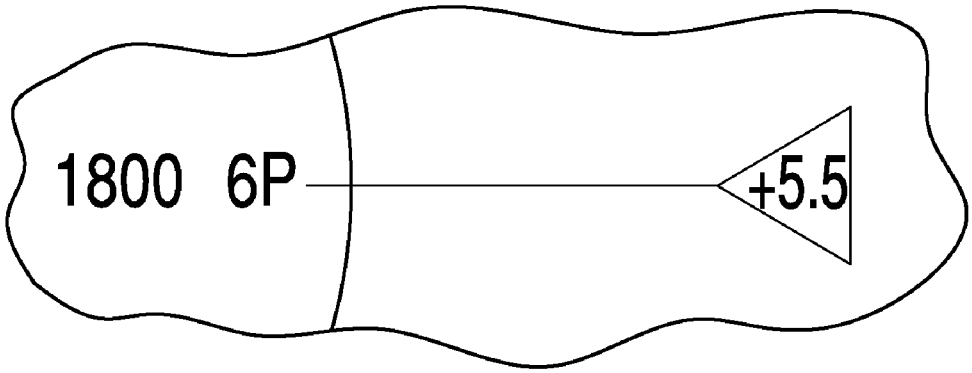

Now referring to FIGS. 10A, 10B and 10C, three variations of connecting elements are illustrated by way of illustration and not limitation. FIG. 10A shows a connecting element that is a line with a pointer on one end and a marker on the other end. Time zone information, i.e. a number representing time difference of local time in reference with the Greenwich Mean Time, is presented on the pointer and the marker. FIG. 10B shows a connecting element that is a pointer with a list of geographical locations that belongs to the same time zone. Time zone information, i.e. a number representing time difference of local time in reference with the Greenwich Mean Time, is presented on the pointer. The list of geographical locations can include countries and cities, e.g. Japan, Korea, Tokyo, and Seoul. FIG. 10C shows a connecting element that is a modified pointer with an extended line. Time zone information, i.e. a number representing time difference of local time in reference with the Greenwich Mean Time, is presented on the pointer. This type of connecting element can be used in a device with limited space.

More than one language can be used in the present invention. When more than one language is used, two or three languages or scripts may be used side by side and the sort order of the languages may be based on the order of the language of preference.

The present invention provides a global scheme of time zones and specific list of locations in reference to one location to another, either during standard time or adjusted time. It also covers locations that use half hour time zone and locations that use GMT+13, which no available method can handle at the present time. It can expand the inventory of the locations significantly by adding space with the foldable method and by adding maps.

Referring now to FIGS. 11A-F another embodiment of the comprehensive time determining system is illustrated, designated generally as 112. A base section 114 is preferably circular and includes a list of geographical locations 116 located on a periphery thereof. The base section 114 further includes a plurality of time zones associated with the geographical locations. The time zones are presented on a time strip 118 on the base section 114. The list of geographical locations 116 on the base section 114 includes locations using standard time only.

A first movable section, designated generally as 120 includes a northern hemisphere portion 122 and a southern hemisphere portion 124. The northern hemisphere portion 122 and a southern hemisphere portion 124 are each independently movable relative to the base section 114. The northern hemisphere portion 122 includes a list of northern hemisphere geographical locations. The southern hemisphere portion 124 includes a list of southern hemisphere geographical locations. The lists on the first movable sections contain locations using dual time. The northern hemisphere portion 122 and the southern hemisphere portion 124 are movable to select a desired position depending on the season. The northern hemisphere portion 122 includes a part for the U.S. and another part for Europe and part of Asia. Both portions 122 and 124 of the first movable section 120 are so arranged and constructed to allow the user to be able to view the time strip 118 that is located on the base section 114. The northern hemisphere portion 122 and the southern hemisphere portion 124 are each presented as a partial segment of a circle.

The northern hemisphere portion 122 and the southern hemisphere portion 124 are preferably separate components independently and adjustably mounted on the base section 114 between the base section 114 and a second movable section that comprises a rotatable dial 126. FIG. 11D is an exploded bottom perspective view that shows this interrelationship. These components are fastened together by a suitable fastener 128 that provides rotation.

The northern hemisphere portion 122 and the southern hemisphere portion 124 each comprise an arcuate slit 130, 132 formed therein for engagement with an associated stopper element 134, 136 securely positioned on the base section 114. The portions 122, 124 thus are able to have a "push-pull" relationship because summer in the northern hemisphere means winter in the southern hemisphere. If the beginning or ending of advanced time in the U.S. or in Europe is not the same, that is, if the U.S. and Europe do not change from standard time to advanced time, or vice versa, at the same time, these two parts may be separated. They are able to accommodate one hour movement (rotation of 15 degrees clockwise or counter-clockwise). As noted above, standard time locations are written on the surface of the base section 114 and dual time locations are on the movable portions 122, 124.

The movable portions 122, 124 may be transparent, or have transparent sections thereon to allow the user to be able to view the time strip 118 on the base section 114. Alternatively, each portion 122, 124 may include a cutout on an inner peripheral surface thereof to provide such viewing. If a transparent material is used, the dual time section may be on either the inner or outer perimeter of the base section 114.

The dial 126 is rotatable relative to the base section 114 and to the first movable section 120, the dial 126 comprising evenly spaced markers 138 positioned about a periphery thereof representing the hours in a day. The dial has a cross type time indicator on the center with four time markers at the edge (e.g., 0, 6, 12, and 18) for easy recognition and operation. It is also marked with two crescent moon shape between the cross type time indicator and 24 time markers (1 a.m., 2 a.m., etc.), a first moon shape covering 6 p.m. to 6 a.m. having a color denoting night time, and, a second moon shape covering from 6 a.m. to 6 p.m. having another color denoting daytime.

During use, an operator selects a location on either the base section 114 or the first movable section 120 and adjusts the first movable section 120 depending on the season, and sets the dial 126 so that a reference time on the dial element is set to a reference time on the time strip 118, and can then use the evenly spaced markers 138 on the dial 126 to determine time at any selected geographical location on the base section 114 or first movable section 120.

Figure 11A:
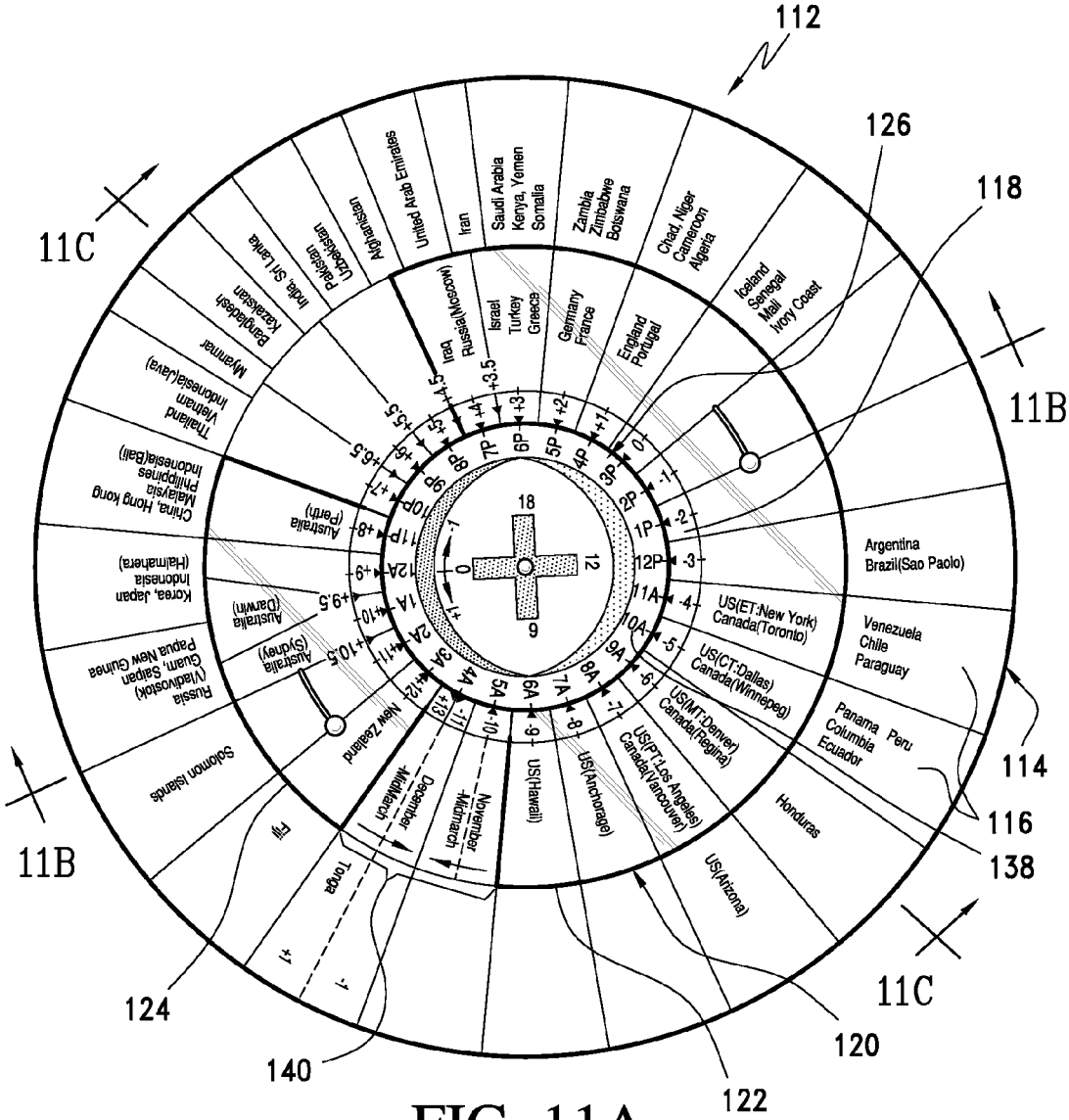
FIG. 11A is front view of another embodiment of the present invention which uses a movable section including a northern hemispheric portion and a southern hemispheric portion independently mounted on a base section and a second movable section including a dial mounted on top of the first movable section.
Figure 11B:
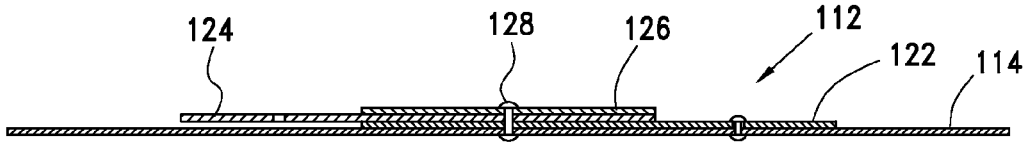
FIG. 11B is a view shown along line 11B-11B of FIG. 11A.
Figure 11C:
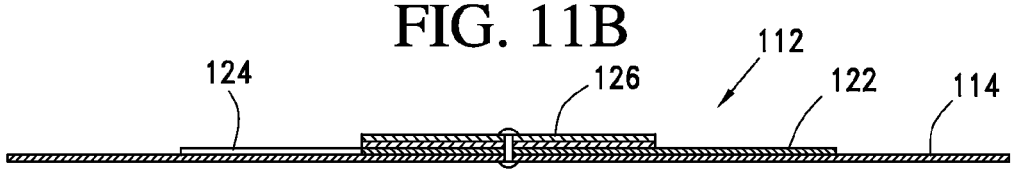
FIG. 11C is a view shown along line 11C-11C of FIG. 11A.
Figure 11D:
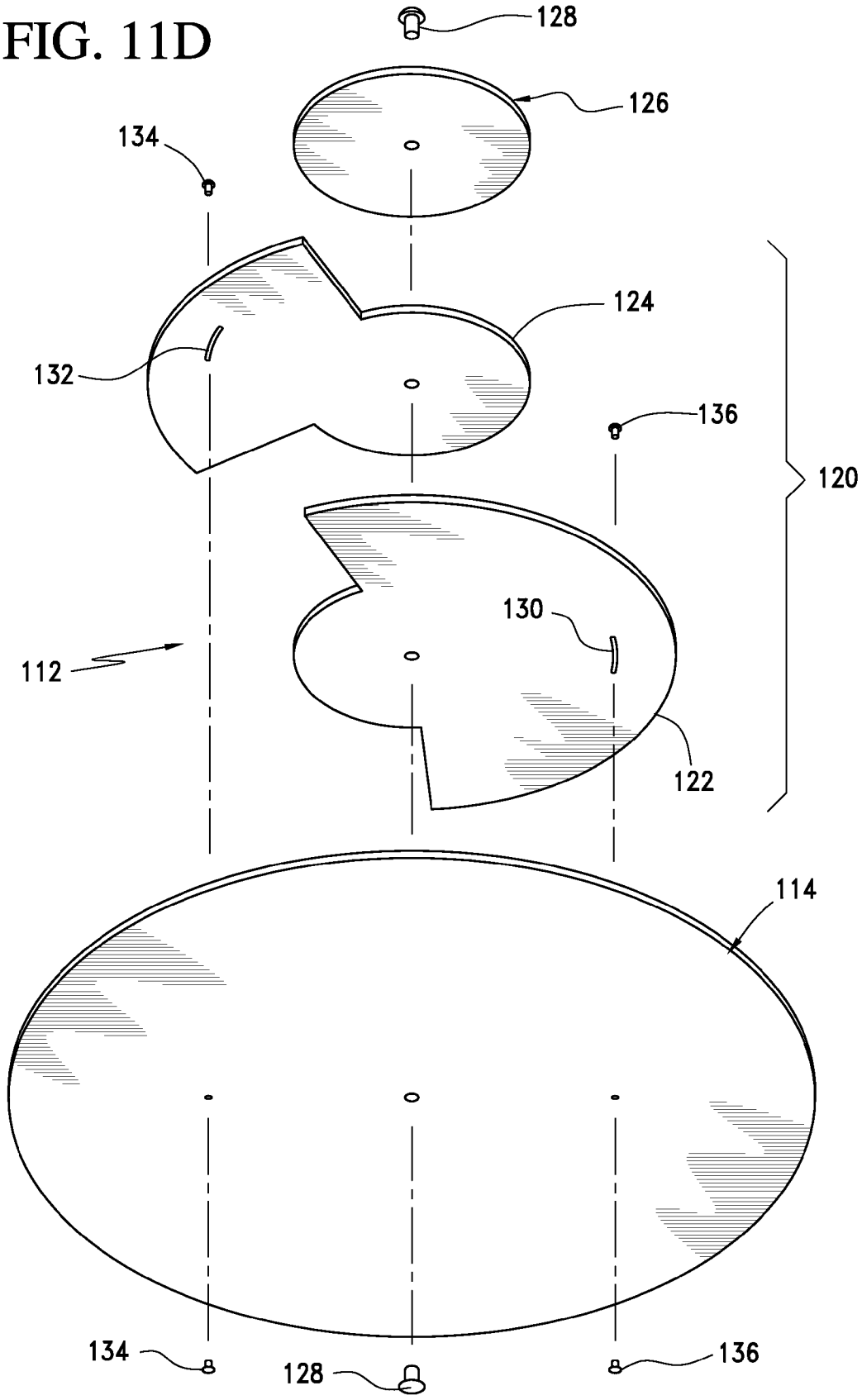
FIG. 11D is a bottom exploded perspective view of the embodiment of FIG. 11A.
Figure 11E:
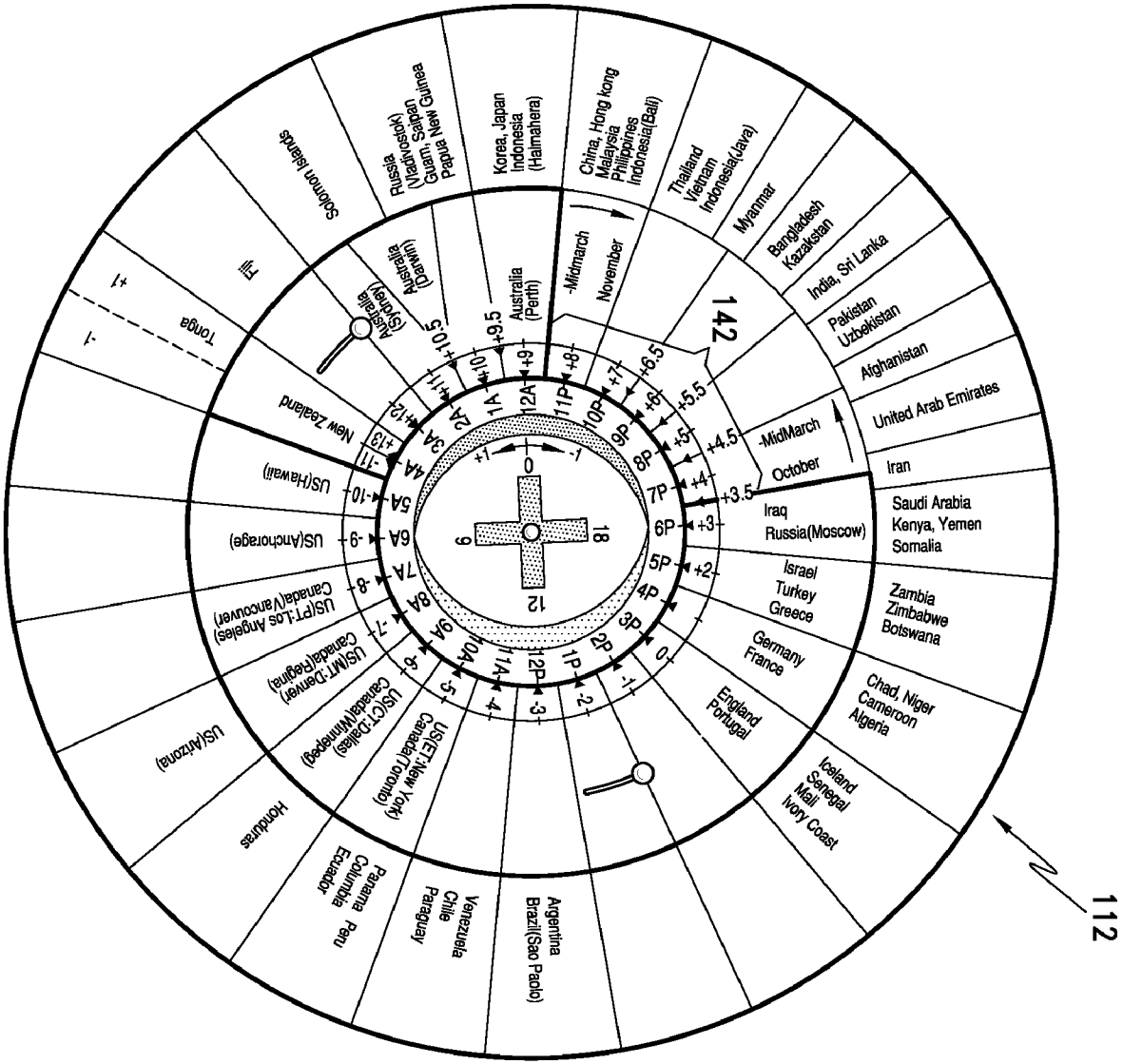
FIG. 11E is a front view of the embodiment of FIG. 11A, with the northern hemispheric portion and the southern hemispheric portion being translated to show a seasonal change.

FIG. 11E shows how the movable portions 122,124 have been moved to close the gap 140 (that is shown in FIG. 11A) to create a gap 142 in accordance with present season. It is noted that the Greenwich Mean Time (GMT) +13 points to −11, +1 being noted near +13 and −1 being noted near −11 to indicate that there is a 24 hour time difference between +13 and −11. There is a place named Samoa in the standard time section of GMT−11 region, next to Tonga.

Figure 11F:
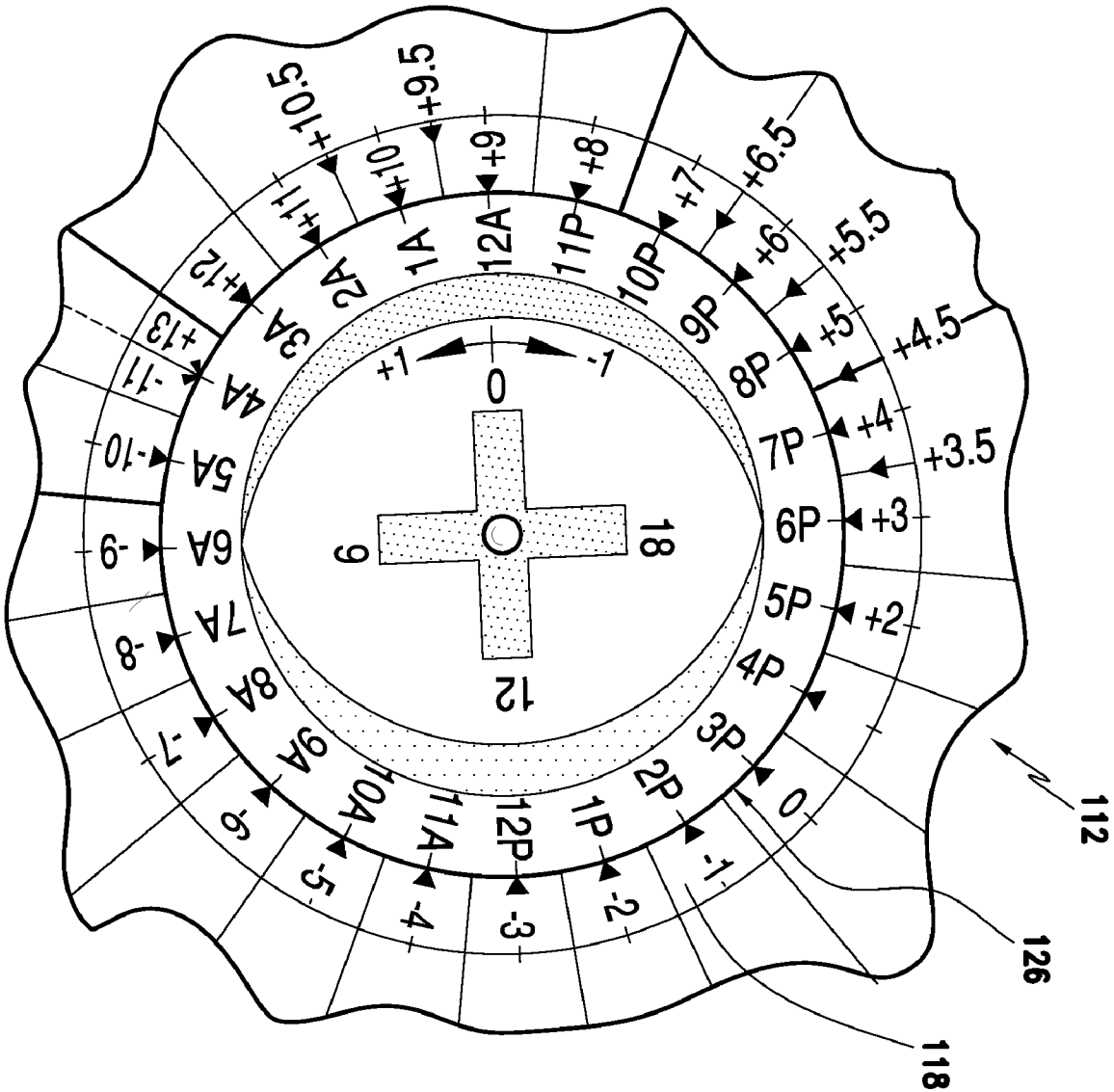
FIG. 11F is an enlarged view of the center portion of the embodiment of FIG. 11A showing the dial in relation to the time strip on the base section.

FIG. 11F is enlarged view area of the dial 126 and time strip 118 portions of the comprehensive time determining system 112

Other embodiments and configurations may be devised without departing from the spirit of the invention and the scope of the appended claims.

For example, the invention in another broad aspect, may include an embodiment such as discussed relative to FIGS. 1-7B, but with only a map section and a dial section, the list section being omitted. In such an instance regions in the map section may be associated with time zones on the time strip on the map section by color coding or numeral designations.

In another broad aspect, although with respect to the FIGS. 1-7B embodiment the list section has been discussed as being on one side (i.e. right side) of the dial section it may be positioned adjacent to the top, bottom, and/or other side (i.e. left side) of the dial section.

It is noted that all seasonal information (e.g., April-October or November-March) is illustrative, thus, it may subject to change by year or each location's political change.

The invention claimed is:

1. A comprehensive time determining system, comprising:

a) a base section comprising a list of geographical locations located on a periphery thereof, said base section further including a plurality of time zones associated with said geographical locations, said time zones being presented on a time strip on said base section, said list of geographical locations on said base section including locations using standard time only;

b) a first movable section comprising a northern hemisphere portion and a southern hemisphere portion, said northern hemisphere portion and said southern hemisphere portion being each independently movable relative to said base section, said northern hemisphere portion comprising a list of northern hemisphere geographical locations, said southern hemisphere portion comprising a list of southern hemisphere geographical locations, said lists on said first movable sections containing locations using dual time, said northern hemisphere portion and said southern hemisphere portion being movable to select a desired position depending on the season, said first movable section being so arranged and constructed to allow the user to be able to view said time strip located on said base section; and, c) a second movable section comprising a rotatable dial, said dial being rotatable relative to said base section and to said first movable section, said dial comprising evenly spaced markers positioned about a periphery thereof representing the hours in a day, wherein, said base section is circular, and said northern hemisphere portion and said southern hemisphere portion are each presented as a partial segment of a circle, said northern hemisphere portion and said southern hemisphere portion being adjustably mounted on said base section; and, wherein during use, an operator selects a location on either said base section or said first movable section and adjusts said first movable section depending on the season, and sets said dial so that a reference time on said dial element is set to a reference time on said time strip, and can then use said evenly spaced markers on said dial to determine time at any selected geographical location on said base section or first movable section.

2. The system of claim 1, wherein said northern hemisphere portion and said southern hemisphere portion each comprise separated subportions if the beginning or ending of advanced time in regions thereof are not the same.

3. The system of claim 1, wherein said northern hemisphere portion and said southern hemisphere portion are each formed of transparent material to allow the user to be able to view said time strip on said base section.

4. The system of claim 1, wherein said northern hemisphere portion and said southern hemisphere portion each include a cutout on an inner peripheral surface thereof to allow the user to be able to view said time strip on said base section.

5. The system of claim 1, wherein said northern hemisphere portion and said southern hemisphere portion are each separate components independently mounted on said base section between said dial and said base section.

6. The system of claim 5, wherein said spaces on said base section viewable between said northern hemisphere portion and said southern hemisphere portion contain seasonal information for appropriate adjustment of said northern hemisphere portion and said southern hemisphere portion.

7. The system of claim 6, wherein said northern hemisphere portion and said southern hemisphere portion each comprise an arcuate slit formed therein for engagement with an associated stopper element securely positioned on said base section.

* * * * *